United States Patent [19]

Düringer

[11] Patent Number: 4,651,545

[45] Date of Patent: Mar. 24, 1987

[54] COMBINATION LOCK

[75] Inventor: Rudi H. Düringer, Wuppertal, Fed. Rep. of Germany

[73] Assignee: S. Franzen Söhne (GmbH & Co.), Solingen, Fed. Rep. of Germany

[21] Appl. No.: 648,550

[22] Filed: Sep. 10, 1984

[30] Foreign Application Priority Data

Sep. 21, 1983 [DE] Fed. Rep. of Germany ..... 3333999

[51] Int. Cl.[4] ..... E05B 37/02

[52] U.S. Cl. ..... 70/312; 70/316

[58] Field of Search ..... 70/312, 314, 315–318, 70/305

[56] References Cited

U.S. PATENT DOCUMENTS

| | | | |
|---|---|---|---|
| 1,343,145 | 6/1920 | Kosich | 70/312 |
| 2,136,493 | 11/1938 | Denerich . | |
| 2,725,739 | 12/1955 | Check | 70/315 X |
| 3,452,563 | 7/1969 | Atkinson | 70/312 |
| 4,155,234 | 5/1974 | Bako | 70/316 X |
| 4,385,509 | 5/1981 | Milles et al. | 70/312 X |

*Primary Examiner*—Robert L. Wolfe

*Attorney, Agent, or Firm*—Martin A. Farber

[57] ABSTRACT

A combination lock has a plurality of shaft-mounted setting discs located behind viewing windows in a front plate of a lock housing. The setting discs have setting symbols and detent engage in individual angular positions. Locking sleeves are adjacent and cooperate with the setting discs. A spring-biased rocker has feeler projections with feeler surfaces which cooperate with engagement spaces in the locking sleeves. The rocker is adapted to engage a mating locking part of the lock. When the lock combination is properly set, the engagement spaces lie in respective positions opposite the feeler projections. The rocker comprises a U-shape including U-arms which surround the setting discs and the locking sleeves. The setting discs are mounted on respective shafts, and the rocker has an axis extending transverse to a plane through the respective shafts of the setting discs.

4 Claims, 18 Drawing Figures

FIG. 1
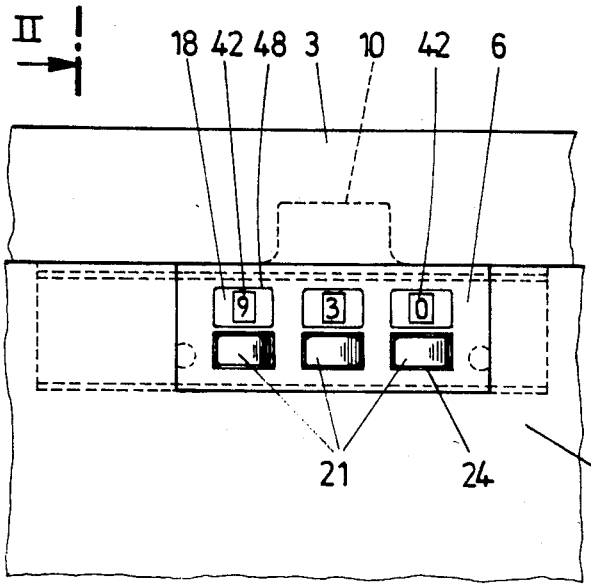
FIG. 2
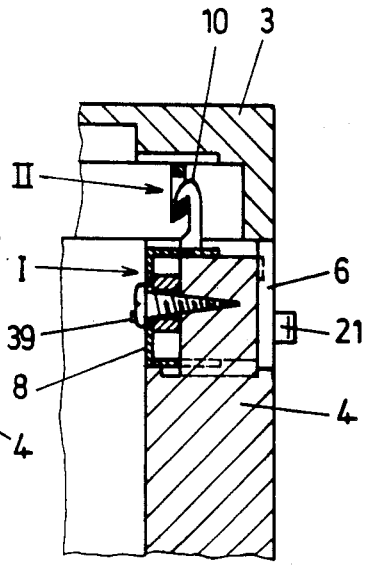
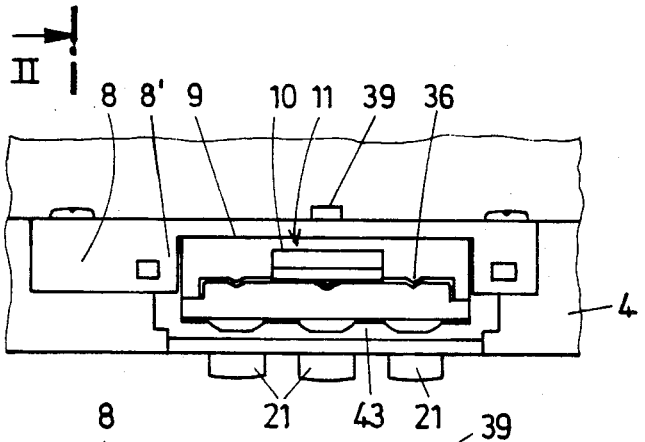
FIG. 3
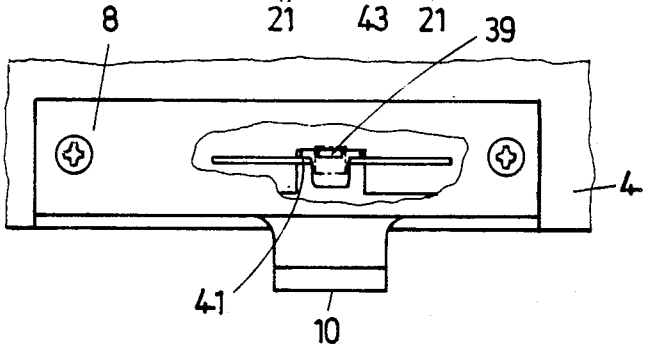
FIG. 4

COMBINATION LOCK

FIELD AND BACKGROUND OF THE INVENTION

The present invention relates to a combination lock having a plurality of shaft-mounted setting discs which lie behind viewing windows of the front plate of the lock housing, bear setting symbols, and engage by detent engagement in their individual angular positions, adjacent which setting discs there are locking sleeves which have engagement spaces for feeler surfaces of a spring-biased rocker which, catches the mating locking part, the engagement spaces lying opposite the feeler projections when the lock combination is properly set.

A combination lock of this type is known from U.S. Pat. No. 2,136,493. There the axis of the rocker extends parallel to the axis of the setting discs. The distance between the axes is determined by the diameter of the setting discs. In order therefore, despite a relatively large distance between axes, to obtain a sufficient opening stroke for the latch of the bolt member which is developed as a rocker, the engagement spaces for the feeler surfaces must be cut quite deep. They are developed there as a flattening of the locking-sleeve collar. The region of the flattening extends over about 115°. If one takes into account the detented division by 10 of the setting disc then the bolt member which is under spring biasing exerts a moment of rotation on the locking sleeve in two adjacent detent positions. In case of unfavorable tolerance fits of the inner part of the lock, this may lead to automatic lining up if the lock combination with respect to the other setting discs/locking sleeves also has not been sufficiently "erased". There is also the disadvantage that, depending on the direction of rotation of the locking sleeve, the bolt member experiences a different opening or closing stroke, which also can lead to complications in operation. The depth of the engagement spaces is subject to limitations based on manufacture and stability since there is an ever-increasing trend towards making the corresponding inner parts of plastic.

SUMMARY OF THE INVENTION

The object of the invention is to provide a combination lock of this type with direct actuation of the rocker in a structurally simple and compact manner so that a high reliability of locking is obtained with a small feeling depth.

According to the present invention the rocker (11) is of U-shape and its U-arms (11') surround the setting discs (18) and locking sleeves (19) and the rocker axis (x—x) extends transverse to a plane (E—E) through the shafts (28) on which the setting discs (18) are mounted.

As a result of this development, a combination lock of the introductory-mentioned type is obtained which is simple to manufacture and reliable in use. Due to the fact that the rocker axis now extends transverse to the vertical plane through the axis of the respective setting discs, a stroke of the latch which is sufficiently large for the release of the mating locking part can be obtained despite engagement spaces of relatively low feeler depth. The locking sleeve is flattened in longitudinal direction. The rocker axis can thus be brought much nearer into the region of the feeler space, with the substantial advantage of a shorter lever arm. The position of the axis thereof is no longer determined by the size of the setting discs. Such a combination lock can therefore be made extremely compact since the U-arms of the U-shaped rocker surround the combination mechanism. The inside of the lock case is in this way completely utilized. It is furthermore advantageous that the setting discs can be actuated by push buttons with the interposition of a stepping mechanism and that the axis of the rocker lies approximately on the plane of the stepping mechanisms. The corresponding linear actuation, in contradistinction to the conventional rotary actuation, is substantially more advantageous in use. Greater forces can be applied. There is also the advantage that the rocker extends into a latch hook with a degree of freedom in the opening direction when movement around the axis of the rocker is blocked. In this way a suitcase or the like can be closed even if the combination of the lock is not set. The additional movement takes place in favorable manner around the contact region between the feeling surface and the outer surface of the locking sleeve. In this respect also, the contact without moment of rotation between the feeler surface and the locking sleeve is advantageous. The load acts precisely in the plane of the axis of the setting discs. The feeler surfaces are developed as projections and the engagement spaces as notches. This is also advantageous insofar as the notches take up a far smaller angular region of the circumference than feeling surfaces formed as flattenings. Furthermore, steeper notch flanks can also be made as a basis due to the push buttons; greater actuating forces can be applied via the latter. Upon the depression stroke, the notch has already emerged from the region of the projection, namely when the second half of the angle of rotation of the setting disc is introduced by the return spring of the stepping mechanism. In this stage, therefore, no locking flank need be overcome any longer. The projection rather slides over the cylindrical outer surface of the locking sleeve, i.e. the latter moves below said surface. It is furthermore favorable that the locking sleeves have an annular step which is interrupted by at least one flattening and lies in front of a bridge of the housing which extends over all locking sleeves. This annular step, which is formed by a collar of the locking sleeve, blocks the uncoupling between locking sleeve and setting disc except in the position in which the lock combination is set. The corresponding disengagement means are simple and suitably shaped. For this, the shafts for the locking sleeve extend from a common arm of a slide which has a handle extending out of the lock housing, the individually overhung shaft being equipped with radially outward pointing driver wings which act on the locking sleeves. The driver wings lie in an angular region of rotation which does not coincide with the detented decimal division of the setting disc. In this way a dependable entrainment is assured in all cases upon the disengagement movement of the locking sleeves. Finally it is also advantageous that the back of the handle jumps over the freely tensioned section of a detent spring. The slide is thus held reliably in its basic position. Finally, another advantageous feature is that the lock housing is gripped around by a U-shaped part which is clipped on from the bottom side and extends over lateral lugs of the rocker. The rocker is in this way held reliably. Finally, it fulfills another additional function if it has a release finger for moving the slide back into its basic position.

BRIEF DESCRIPTION OF THE DRAWINGS

Further advantages and details of the invention are described in detail below with reference to an embodiment shown in the drawing, in which:

FIG. 1 is a top view of the combination lock in approximately actual size, mounted on a suitcase or the like;

FIG. 2 is a section along the line II—II;

FIG. 3 shows the combination lock in a side view, seen from the side of the latch hook;

FIG. 4 is a bottom view thereof with the U-shaped part partially broken away;

DETAILED DESCRIPTION OF THE PREFERRED EMBODIMENT

Figure 6:
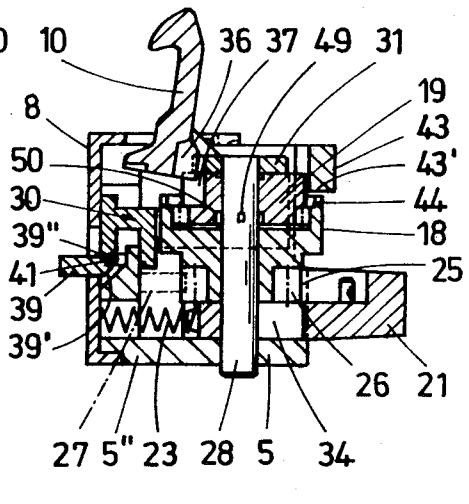
FIG. 6 is a section along the line VI—VI of FIG. 5, in the opening position.

The combination lock consists of a combination-lock part I and a mating closing part II in the form of an eye. The latter is seated in the lid 3 of a suitcase or the like while the combination-lock part I is fastened in the edge section of the shell-shaped bottom part 4 of the suitcase near the joint, as seen in FIGS. 1 and 2.

The equipment of the combination-lock part I is contained in an elongated rectangular lock housing 5. The latter is closed on top by a front plate 6. The front plate 6 is attached by snap engagement to the lock housing. For this purpose, holding tongues having window-shaped openings (not shown in detail) extend from the bottom of the front plate. Noses 7 attached to the housing engage in these openings (see FIG. 5).

As seen in FIG. 3, the lock housing 5 is gripped around by a U-shaped part 8 which is clipped on from the bottom side of the lock housing. At least its one U-arm 8′ has a notch 9 extending from the edge of the arm. The notch is passed through by the latch hook 10 of a bolt member shaped in the form of a rocker 11. This bolt member is a U-shaped structural part. Outwardly pointing stub axles 12 forming the rocker axis x—x are developed in the end region on the two U-arms 11′ of said part. The housing-side axle receivers are designated 13. They are mounting shafts which are open towards the bottom 5′ of the lock housing 5 and therefore permit the rocker operation. The opening thereof lies transverse to the U-arms 11′. Both stub axles are held in the axle receivers 13 by compression springs 14 which urge the latch hook in the direction towards the release or open position. These springs are coil compression springs. They extend in the vicinity of the stub axles 12 directly below the U-arm 11′. Their end there is engaged on a stud 15. The other end of the spring is seated secured in position in a hollow 16 in the bottom 5′ of the housing. Said bottom is entirely broken through so that the compression springs rest against the inner surface of the U-shaped part 8. The lock housing is secured by means of holding screws which at the same time grasp the U-shaped part (see FIG. 2).

Figure 7:
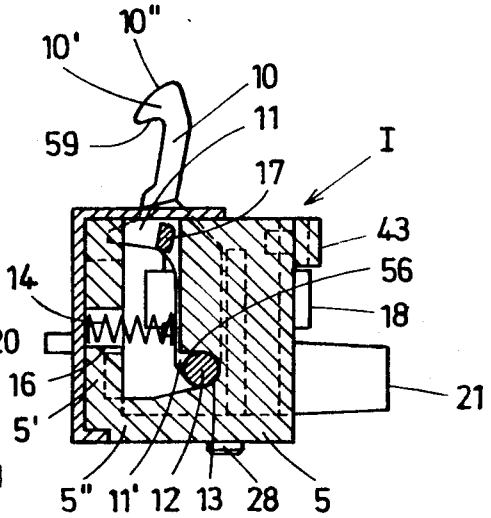
FIG. 7 is a section along the line VII—VII of FIG. 5, also in the opening position.
Figure 14:
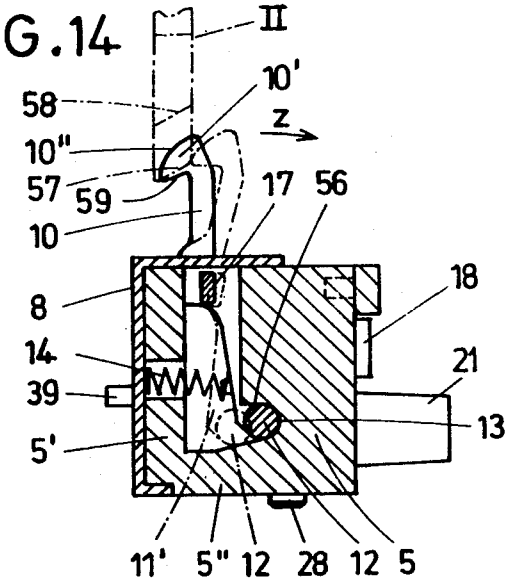
FIG. 14 is a section corresponding to FIG. 7, showing the function of the latch.
Figure 18:
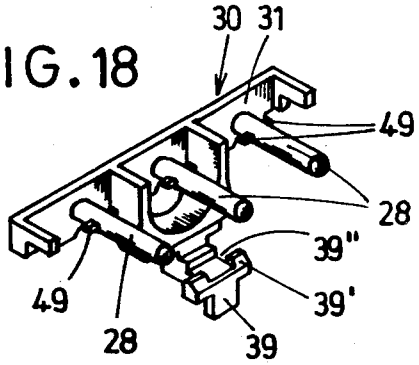
FIG. 18 is a perspective view of the slide which carries the locking sleeves and setting discs.

As seen in FIG. 7, on the outside of each U-arm 11′, approximately at the height of the U-web of the rocker 11, there is developed a short lug 17. The lug is gripped over by the U-arm 8′ of the U-shaped part 8. The rocker is in this way secured against being pulled out. It is mounted in a tilted position, as can be noted essentially from the dash-dot line showing in FIG. 14.

Figure 5:
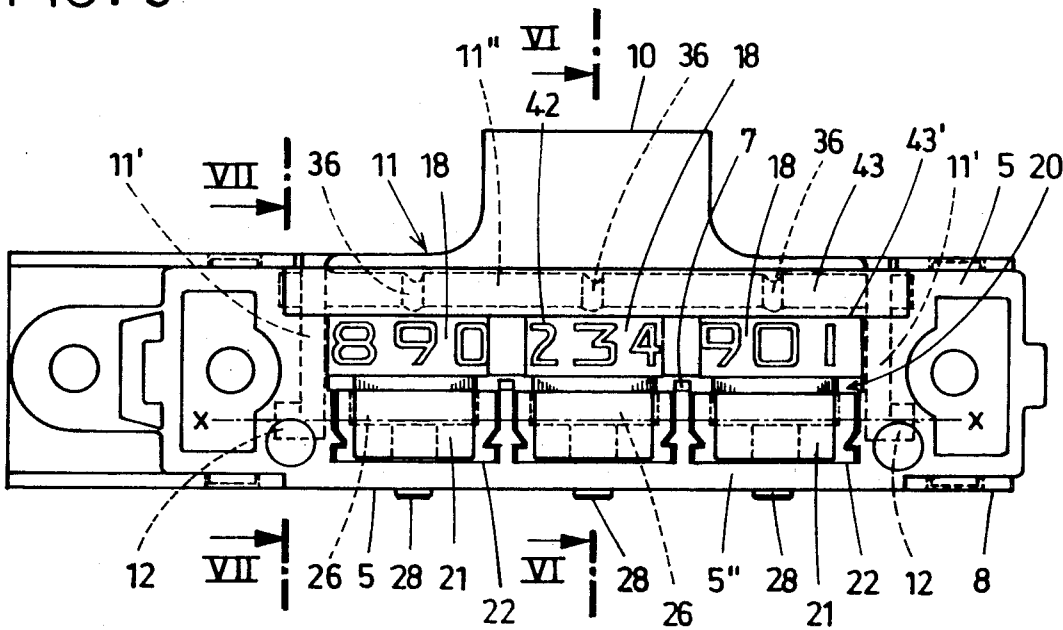
FIG. 5 shows the combination lock by itself in top view with front plate removed, on a larger scale.

The U-arms 11′ surround the inner part which consists of setting discs 18, locking sleeves 19 and individual stepping mechanisms 20. These means 18, 19, 20 are provided in triplicate and all of them are located in the U-space of the rocker 11 (FIG. 5).

A push button 21 is arranged in front of each stepping mechanism 20, the function of which is described in detail, incorporated by reference herein, in patent application P 30 38 481.7 (corresponding to U.S. Pat. No. 4,385,509). These push buttons move in separate shafts (passageways) 22 of the lock housing 5 under the load of a compression spring 23 and for their accessibility for actuation pass through window-shaped openings 24 in the front plate 6. The push button 21 has two shift fingers 25 which cooperate with a switch star 26 developed on the setting disc. One half of the movement of rotation, which extends over precisely 36°, is passed over upon the active downward depressing of the push button 21, which takes place against the force of the spring 23. Upon the following spring-urged upward displacement of the push button, the remaining half revolution of the switch star 26 is effected. The corresponding basic position of the setting disc 18 is in this way secured by the spring biased basic position of the push button 21. Reverse turning prevention for the forward switching step of the push button is provided by a detent spring 27; the latter is formed already on the bottom 5′ of the plastic lock housing 5 during its molding. It is a tongue which points in the direction of the switch star 26 and engages in the spaces between its teeth. As can be seen, the interposed stepping mechanism 20 and the push button 21 in front of it lie approximately in the plane of the rocker axis x—x (see FIG. 10) arranged lengthwise in the lock housing slightly behind the setting disc.

The individual setting discs 18 together with corresponding locking sleeves 19 are mounted on overhung shafts 28 of a slide 30 which is transversely displaceable, limited by a stop, in the lock housing. The shafts 28, which are arranged at the same height, extend from a common arm 31 which lies above the place of emergence of the latch hook. They are held therein fixed against rotary and axial movement and have their ends supported in separate bore holes 33 in the lock housing wall 5″ which is located on the side opposite the place of emergence of the latch hook. Since the shaft intersects the push button 21 the latter has a longitudinal slot 34 which corresponds to the actuating stroke.

The rocker axis x—x extends transversely to the vertical plane E—E through the shaft 28 of the setting discs 18. The locking sleeve 19, which is partially mounted in a pot-shaped depression 18′ in the setting disc 18, is contacted on the free section on its outer surface 35. The rocker-side feeler surface is developed as respective projections 36 on the web 11″ of the rocker 11. Each of these projections cooperates with a corresponding engagement space in the form of a notch 37 on each respective locking sleeve 19. The notch has relatively steep flank angles. The flank emergence extends over an angle which is less than in the case of the decimal division of 36°. If all notches 37 are so directed that they are located opposite the projections 36 on the web 11″ of the rocker 11, then the rocker swings into the open position (FIG. 6). On the other hand, if only one of the push buttons is actuated the corresponding tooth-like projection 36 is disengaged, it being lifted, with change in the position of inclination of the rocker 11, onto the outer surface of the locking sleeve 19. The locking position which has now been brought about can be noted from FIG. 8 and the situation as to the supporting of the two parts can be noted particularly clearly from FIG. 10. Since the crest (peak) of the projection 36 which extends in the lengthwise direction of the shaft 28 lies in the direction of the radii of the locking sleeve 19 and the position of the rocker axis is transverse to the vertical plane E—E of (FIG. 10) the shaft 28, there is a completely neutral stress condition.

Figure 10:
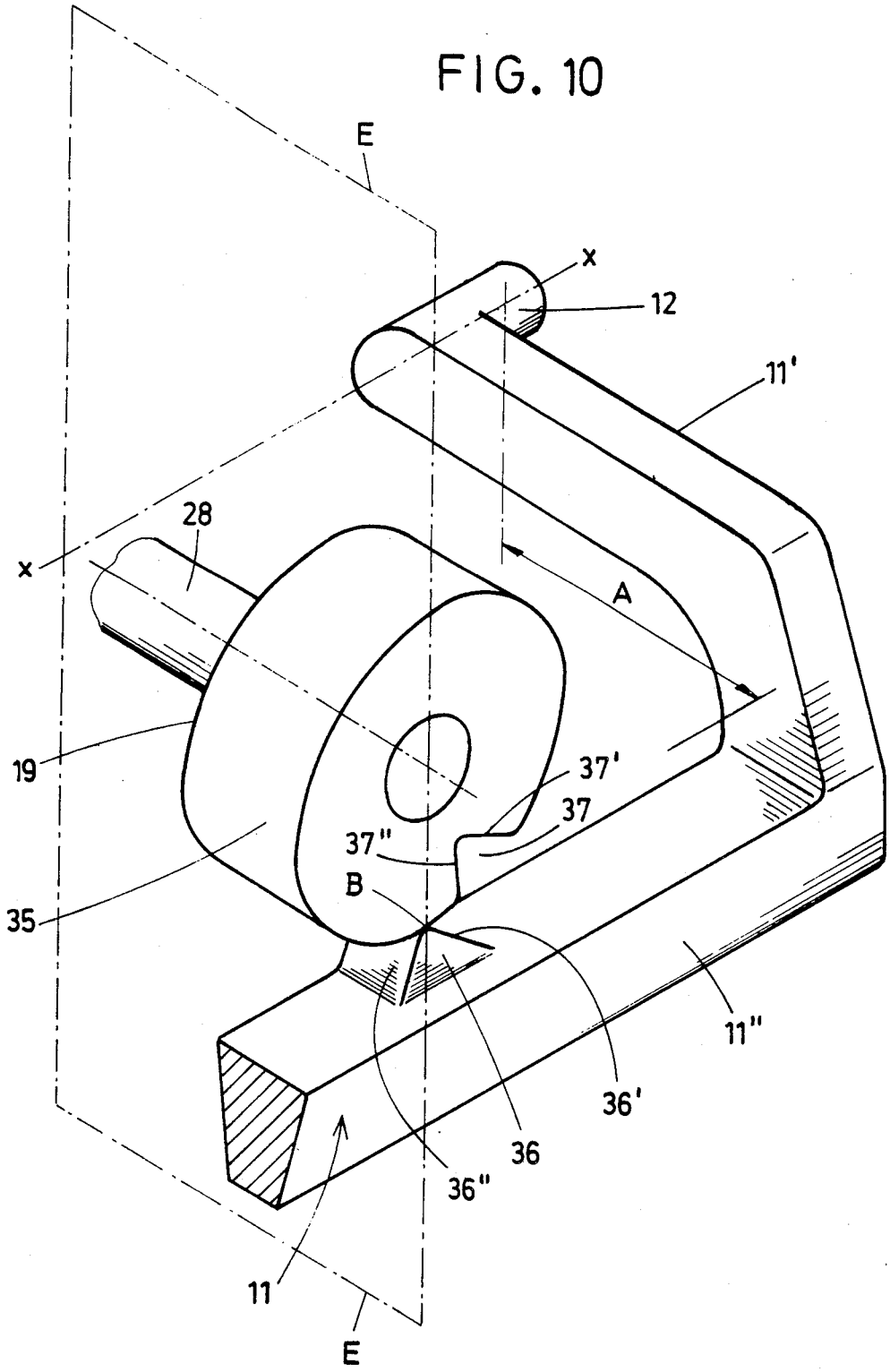
FIG. 10 is a partial view in perspective of the condition of FIG. 8, shown in further enlarged and diagrammatic form.
Figure 13:
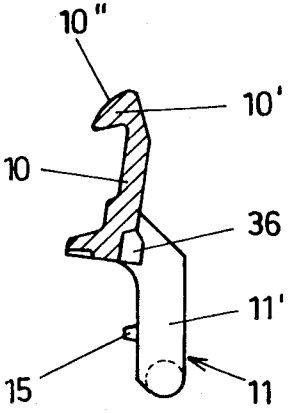
FIG. 13 is a section along the line XIII—XIII of FIG. 11.
Figure 12:
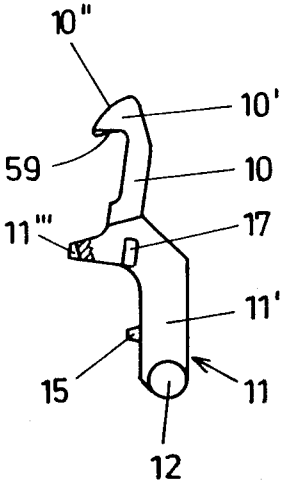
FIG. 12 is the corresponding left hand side view.
Figure 11:
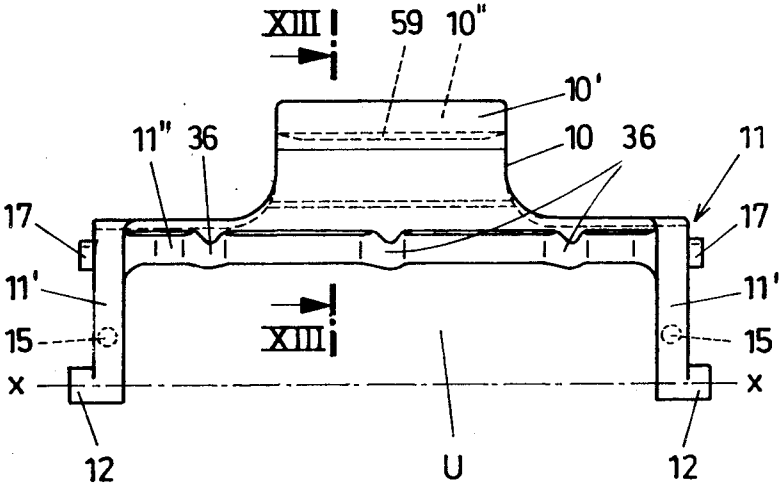
FIG. 11 is an individual view of the bolt member developed as a rocker, seen in top view.
Figure 15:
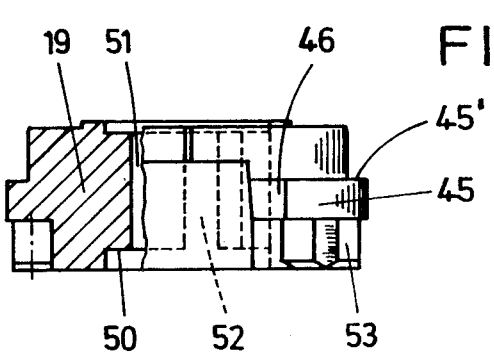
FIG. 15 is an individual view of a locking sleeve in top view, partially in section.
Figure 17:
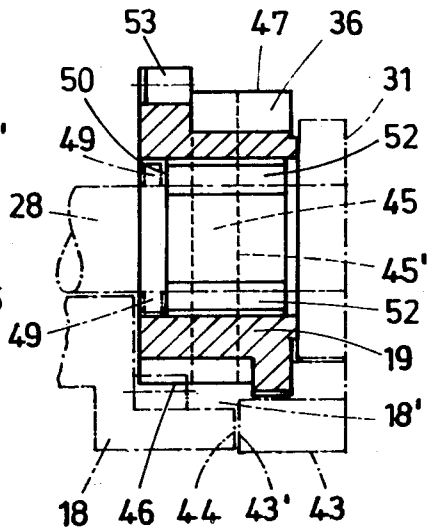
FIG. 17 is a section along the line XVII—XVII of FIG. 16.

Since, furthermore, the setting discs 18 are turned in only one direction, i.e. in clockwise direction in the case of FIG. 10, the right hand flank 36′ of the projection 36 assumes a less steeply inclined course than the other flank 36″. The actuation of the push button is therefore made easier. The notch profile can be shaped accordingly. If it is desired to obtain a well-supporting flat support surface in the locking engagement position so that, for instance, only the longer and thus the larger-area flank 37′ of the notch 37 bears load, then the other notch flank 37″ can, for instance, be cut back somewhat in such a manner that the corresponding flank 36″ does not come into resting contact with it.

Figure 8:
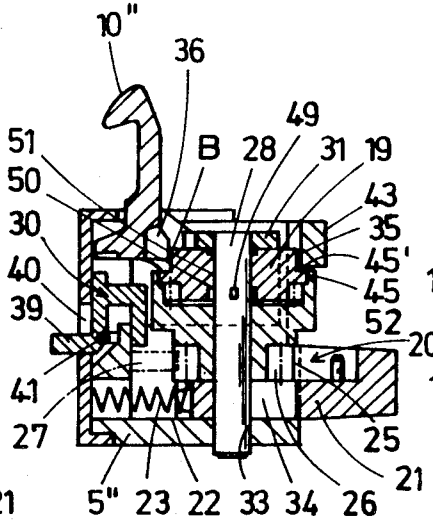
FIG. 8 is a section corresponding to FIG. 6, but in the closed position.
Figure 9:
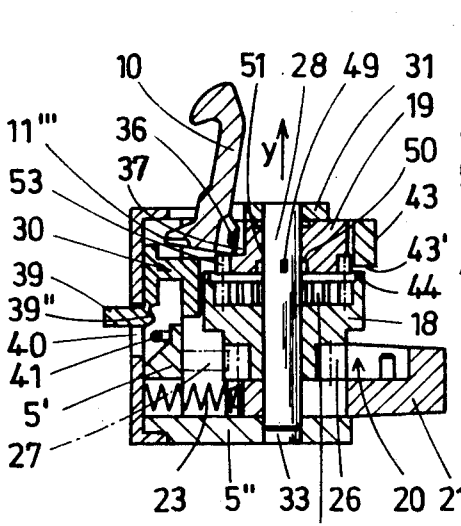
FIG. 9 is a section corresponding to FIG. 6 with locking sleeves disengaged for the resetting of the lock combination.

In order to change the lock combination, the setting discs 18 and locking sleeves 19 which are in toothed coupling engagement with each other are uncoupled. This is done by displacing the slide 30 in the direction indicated by the arrow y (FIG. 9) by means of a handle 39 which extends out of the bottom 5′ of the lock housing. It is formed by a lug which is bent off at an angle from the bottom-side guide part and extends through a window 40 in the shaped part 8. The size of the window corresponds to the required stroke, so that the stop limitation can be utilized from here. The basic position is established by a detent. For this purpose, the handle back 39′, which is provided with a run-on bevel and in front of which there is a slide-side detent fillet 39″, jumps over a freely tensioned section of a bar-shaped detent spring 41. The free ends of the latter are fixed in the lock bottom 5′. The region below the freely tensioned section is so great that the detent spring has the required free space for a deflection movement. The coding-recoding ready position can be noted from FIG. 9. In this position the setting discs 18, which are provided on their periphery, corresponding to the decimal division, with symbols 42, such as, for instance, numbers, which are observed through the viewing window 48 of the front plate, retain their position. They are suitably axially secured on the housing side, namely by a bridge 43. The edge 44 of the setting disc 18 lies in front of the narrow surface 43′ of the bridge on the push-button side. Normally this narrow surface 43′ also prevents axial displacement of the locking sleeves 19, which, for this purpose, have an annular step 45′ formed by a collar 45 which extends radially over the outer surface 35. When the locking sleeves 19 are engaged and therefore coupled, this collar also extends into the pot-shaped depression 18′ of the setting disc 18 so that the annular step 45′ extends in the same plane to the end surface of the setting disc 18 (FIG. 8). The bridge 43 is removable and thus permits the mounting of the inner part of the lock. In the mounted state, the bridge however remains attached to the housing 5. In order, nevertheless, to be able to remove the locking sleeves for uncoupling, the circular collar 45 of the locking sleeves has a flattening 46 which interrupts the annular step 45′. The flattening is diametrically opposite a flattening 47.

Figure 16:
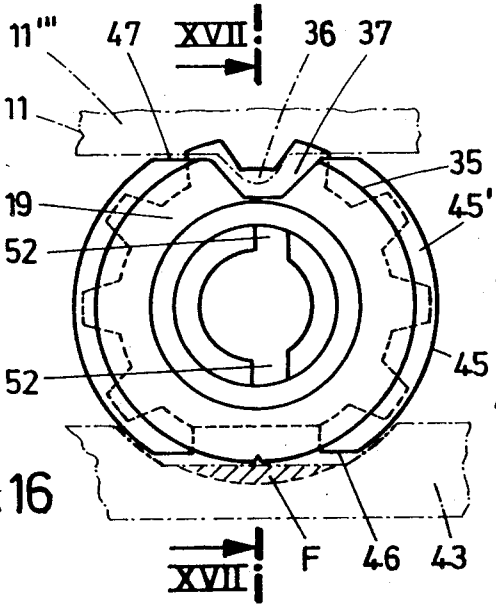
FIG. 16 shows the locking sleeve in side view with associated rocker and bridge, shown in dashed lines.

The flattening 46, when the combination has been properly set, holds the collar 45 out of the blocking field F of the bridge 43, which field is shown hatched in FIG. 16.

The other flattening 47 permits the passage of the annular step 45′—which, accordingly, is also interrupted here—over the web 11″ of the rocker 11 which web bears the projection 36. The notch 37 has a depth in axial direction which corresponds to the stroke of displacement of the locking sleeves 19 (see FIG. 9). Due to the fact that rocker 11 has a release finger 11‴ (FIG. 9) which extends from the bottom of the web 11″ of the rocker and lies directly in front of the slide 30 in the position of readiness for resetting of the lock combination, this position can also be conveniently eliminated simply by swinging the latch hook 10 in the direction towards the closing position.

For the disengagement of the locking sleeves, the shafts 28 have radially outwardly extending, diametrically located driver wings 49. The latter engage behind an annular shoulder 50 arranged on the setting-disc-side of the central locking-sleeve cavity 51. The annular shoulder is formed within a milling into which the driver wings 49 extend. For assembly, longitudinally extending insertion slots 52 of the locking-sleeve cavity 51 extend from said milling. The insertion slots and driver wings can easily be displaced from the axial center. Their position with respect to the engaged decimal is such a division that in assembled state they are not aligned congruently with each other.

In the same transverse plane in which the annular shoulder 50 extends, there are produced, on the outer periphery, also tooth-like coupling projections 53 which engage into corresponding tooth-gap-like depressions 54 of the pot-shaped depression of the setting discs.

The rocker 11 has, beyond its normal opening and closing movement, a degree of freedom which is accessible with movement blocked around the axis of the rocker. This degree of freedom produces the latch function. With the lock mechanism, for instance, in the locking position and the lid of the suitcase open, the latch hook 10 moves away in the direction indicated by the arrow z (FIG. 14) in opposition to its spring force. This additional movement takes place around the region of contact B between feeler surface, i.e. the projection 36, and the outer surface 35 of the corresponding locking sleeve 19. This loading is also free of moment of rotation. As can be noted from FIG. 14, the rocker axis x—x swings in this connection, with a true rocker movement, out of the axial recess 13 (shown in dashed line). Since in this case, the rocker moves away from the flank 56 on the side of the mating lock part, which is formed by the receiver, the lugs 17 take over the function of securing of the rocker 11 in the lock housing 5.

The back 10'' of the head 10' of the latch hook 10 is bevelled in such a manner that it serves as run-on surface for the correspondingly bevelled free end 57 of the mating-locking part II. The eye hole has a corresponding oblique surface 58 which is gripped over by the hook inner surface 59.

The lever-arm length A of the rocker 11 between axis x—x and contact region B (FIG. 10) can be shortened to far below the dimension of the diameter of the locking discs. This length is no longer determined by that measurement.

The function of the combination lock is, summarized briefly, as follows: By the setting of the lock combination the spring-biased latch hook swings into the open position. The lid of the suitcase is now lowered. By actuation of at least one of the push-buttons 21 the latch hook enters into the locking position, as shown in FIGS. 2 and 8.

If the lock is already in locking position, in which at least one projection 36 rests on the outer surface 35 of the corresponding locking sleeve 19, the sleeve moves by tilting around this contact point B in the direction towards the arrow z in order then to catch the mating locking part.

In order to change the lock combination it is necessary, first of all, to set the current combination. By displacing the slide 30 in the direction of the latch, the locking sleeves are brought into the uncoupling position. By pressing the buttons, the new lock combination can now be selected. The slide 30 is then moved back into its starting position, in accordance with FIG. 8. The ready position for resetting is present only when the annular step 45' which acts as a blocking member has come out of the region, acting as lock, of the bridge 43. This is true when the flattenings 46 and 47 of the locking sleeves 19 lie in the plane E—E.

I claim:

1. In a combination lock having a plurality of shaft-mounted setting discs located behind viewing windows in a front plate of a lock housing, the setting discs having setting symbols and detent engaging in individual angular positions, a spring-biased rocker, said rocker having feeler projections with feeler surfaces, locking sleeves adjacent said setting discs and having engagement spaces for said feeler surfaces, said rocker being adapted to catch a mating locking part of the lock, and said engagement spaces, when the lock combination is properly set, lying in respective positions opposite the feeler projections, the improvement wherein said rocker has a U-shape including U-arms substantially surrounding the setting discs and the locking sleeves, and shafts on which said setting discs are respectively mounted, and said rocker having a rocker axis extending transverse to a plane through the respective shafts for the setting discs, a bridge of the lock housing extends over all said locking sleeves, said locking sleeves further comprise an annular step which is at least partially interrupted by a flattening, said annular step is located in front of said bridge.

2. In a combination lock having a plurality of shaft-mounted setting discs located behind viewing windows in a front plate of a lock housing, the setting discs having setting symbols and detent engaging in individual angular positions, a spring-biased rocker, said rocker having feeler projections with feeler surfaces, locking sleeves adjacent said setting discs and having engagement spaces for said feeler surfaces, said rocker being adapted to catch a mating locking part of the lock, and said engagement spaces, when the lock combination is properly set, lying in respective positions opposite the feeler projections, the improvement wherein said rocker has a U-shape including U-arms substantially surrounding the setting discs and the locking sleeves, and shafts on which said setting discs are respectively mounted, and said rocker having a rocker axis extending transverse to a plane through the respective shafts for the setting discs, a slide having a common arm and a handle slidably disposed in the lock housing, said handle extends out of the lock housing, and wherein said respective shafts for the setting discs project from said common arm, said locking sleeves are mounted on said respective shafts, said respective shafts have radially outwardly extending driver wings engaging said locking sleeves, respectively, said handle has a back, detent spring means for holding said slide in a position, said detent spring means has a freely tensioned section which snaps over said handle back when said slide is moved into said position.

3. In a combination lock having a plurality of shaft-mounted setting discs located behind viewing windows in a front plate of a lock housing, the setting discs having setting symbols and detent engaging in individual angular positions, a spring-biased rocker, said rocker having feeler projections with feeler surfaces, locking sleeves adjacent said setting discs and having engagement spaces for said feeler surfaces, said rocker being adapted to catch a mating locking part of the lock, and said engagement spaces, when the lock combination is properly set, lying in respective positions opposite the feeler projections, the improvement wherein said rocker has a U-shape including U-arms substantially surrounding the setting discs and the locking sleeves, and shafts on which said setting discs are respectively mounted, and said rocker having a rocker axis extending transverse to a plane through the respective shafts for the setting discs, a slide having a common arm and a handle slidably disposed in the lock housing, said handle extends out of the lock housing, and wherein said respective shafts for the setting discs project from said common arm, said locking sleeves are mounted on said respective shafts, said respective shafts have radially outwardly extending driver wings engaging said locking sleeves, respectively, said slide has a basic position in which said locking sleeves engage said setting discs, the rocker further comprising a release finger means for returning the slide into said basic position.

4. The combination lock according to claim 3, further comprising detent spring means for holding said slide in said basic position.

* * * * *